United States Patent [19]

Levy

[11] 4,123,024

[45] * Oct. 31, 1978

[54] DEVICE FOR DRYING DRIP DRY APPAREL THAT IS EASILY ADJUSTED

[76] Inventor: Harold Levy, P.O. Box 600015, North Miami Beach, Fla. 33160

[ * ] Notice: The portion of the term of this patent subsequent to Jul. 5, 1994, has been disclaimed.

[21] Appl. No.: 800,936

[22] Filed: May 26, 1977

[51] Int. Cl.[2] ..... E04G 3/00

[52] U.S. Cl. ..... 248/214; 211/86; 248/225.3

[58] Field of Search ..... 211/86; 248/212–215, 248/225.3, 225.4, 226.1–226.5, 227–231, 300, 302, 307, 340

[56] References Cited

U.S. PATENT DOCUMENTS

| | | | |
|---|---|---|---|
| 857,820 | 6/1907 | Mosher | 248/214 X |
| 1,398,401 | 11/1921 | Shaw | 248/226.3 X |
| 1,900,796 | 3/1933 | Carter | 211/86 X |
| 2,714,728 | 8/1955 | Bloch | 248/226.5 X |
| 2,725,576 | 12/1955 | Schwersinski | 248/289 X |
| 2,997,182 | 8/1961 | Lewis et al. | 248/230 X |
| 3,055,509 | 9/1962 | Robbins | 211/119 |
| 3,307,710 | 3/1967 | Negri | 248/230 X |

FOREIGN PATENT DOCUMENTS

| | | | |
|---|---|---|---|
| 804,351 | 4/1951 | Fed. Rep. of Germany | 248/215 |
| 1,342,005 | 9/1963 | France | 211/1195 |
| 9,664 of | 1909 | United Kingdom | 248/215 |
| 365,734 | 1/1932 | United Kingdom | 248/227 |

*Primary Examiner*—Lawrence J. Staab

[57] ABSTRACT

The present invention is a support of the suspended type in a form specifically designed for use in drying drip dry apparel, wet clothing, and the like. It may be used to advantage in the bathroom, when it is suspended above the shower doors on the square beam of the shower enclosure, and it is made adjustable to fit all shower door beams which are of different widths.

4 Claims, 5 Drawing Figures

DEVICE FOR DRYING DRIP DRY APPAREL THAT IS EASILY ADJUSTED

It is installed right in front of you providing a convenience in easy handling and straightening out of drip dry apparel while it drips into the bathtub, and also while drying it drips into the bathtub. The device in particular has an arm that suspends the wet apparel over the interior of the bathtub so that while drying it does not drip on the floor. No installation is required and it is put on and taken off the shower door beam with ease, and does not interfere with the opening and closing of the shower doors, therefore it may be left on permanently. In changing from one shower door beam to another of different width the device is simply adjusted. It is completely collapsable as it comes all apart and breaks down to fit into a very minimum of luggage space when travelling. The device can be made of sheet metal, wire, plastic, and other materials.

BACKGROUND OF THE INVENTION

The adjustable drip dry support apparatus is very helpful, useful, and a great convenience in the handling of todays large variety of drip dry products, such as wearing apparel consisting of ladies blouses, slacks, lingerie, hosiery, and mens shirts, pants, underwear, socks, and many other drip dry products. Manufacturers of ladies and mens wear products recommend using the drip dry method of washing and drying, in order to eliminate ironing or having them pressed. Drip dry products such as shirts or blouses have to be straightened out neatly, and any wrinkles pulled out when still wet, this is referred to as straightening out, and then the garment will dry without wrinkles and have the appearance of being neatly pressed. Fabrics used in drip dry products are polyester, nylon, dacron, etc. In the manufacture of these products the fabric is pre-set with heat in order to resist wrinkling after washing during the life of the product, also creases are set into mens pants, etc. in the same manner. The drip dry support holds the hanger and the garment firmly within reach, and in a comfortable position right in front of you in order to easily straighten out and work on the garment, button the buttons etc. and during this whole process the water is dripping into the bathtub. This device will accommodate several garments and many other drip dry articles, and they all drip into the bathtub while drying, this eliminates any water mess whatsoever. Women and short people will find it very helpful as the garment is lowered within their reach. The device is very useful when travelling as it is convenient to wash things at night and have them dry in the morning ready to wear, as clothes are limited when travelling, and the device is completely collapsable as it comes all apart and breaks down to fit into a very minimum of luggage space. This product is adjustable to fit any width shower door beam in hotels, motels, other houses, and therefore it may be taken from place to place while travelling, and even when you move to another home. Hotels may have it for the convenience of their guests, and they can put advertising on it for people to take home with them.

SUMMARY OF THE INVENTION

An adjustable drip dry support apparatus may be used in the bathroom and it is suspended above the shower doors on the square beam of the shower enclosure. These beams are made in different widths, and therefore this device is made to be able to fit onto all these different width beams by being adjustable. The device accomodates drip dry products, and it provides a convenience in easy handling and straightening out of drip dry apparel while it drips into the bathtub, and the apparel may be left on it to dry while continuing to drip into the bathtub. The device is designed to accommodate clothes hangers with garments, articles attached with clothes pins, and a ring for draping things over. The garments are lowered to a comfortable position so that it is easy to straighten out and work on them. No installation is required and it is put on and taken off the shower door beam with ease and does not interfere with the opening and closing of the shower doors. The device is completely collapsable as it comes all apart and breaks down to fit into a very minimum of luggage space when travelling.

DESCRIPTION OF THE PREFERRED EMBODIMENT

Figure 1:
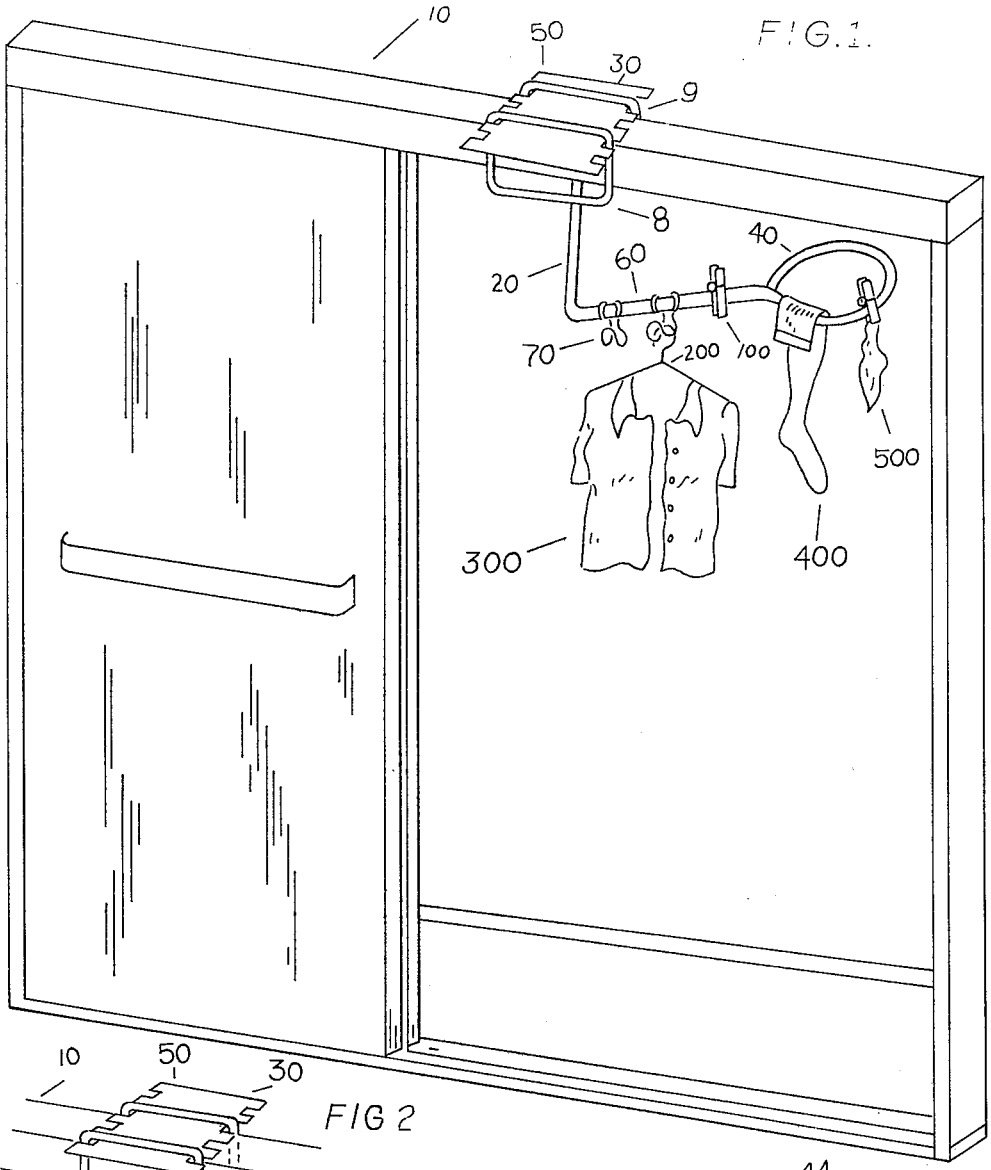
FIG. 1 is a perspective view of a portion of a bathroom showing a shower enclosure with the present invention suspended by the square shower door beam.

FIG. 1 is a perspective view of a portion of a bathroom showing a shower enclosure with two doors supported at the top by a beam of square cross section constituting a conventional installation, with an embodiment of the present device suspended by the square shower door beam to support in proper position drip dry apparel for straightening out and drying, and having the wet garments drip into the bathtub. This is accomplished by having a horizontal load-supporting arm on the device with hooks to hold hangers with garments, and clothes pins to hold apparel over the interior of the bathtub. The drip dry support is fastened securely to the square door beam, by the clamp part of the device consisting of a sheet metal plate with slots and wire holding arms, which may be placed in different slots in order to adjust the clamp to fit different width door beams. These wire holding arms fit tightly against both sides of the door beam so that the clamp is held securely to the door beam.

Figure 2:
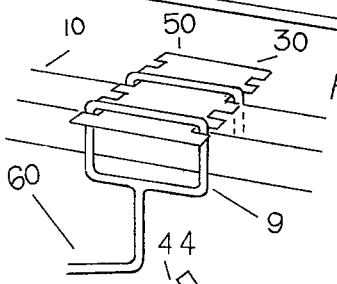
FIG. 2 shows the fastening area or clamp part of the device suspended by the square shower door beam with a view from the rear.

FIG. 2 shows the fastening area or clamp part of the embodiment of the present device suspended by the square shower door beam with a view from the rear.

Figure 3:
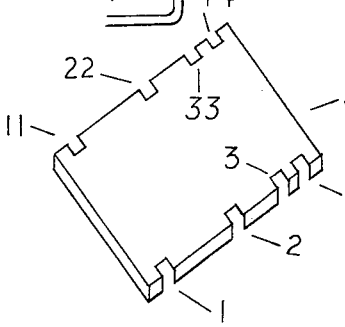
FIG. 3 shows the sheet metal plate part of the clamp of the device with slots spaced in different locations.

FIG. 3 shows the sheet metal plate part of the clamp of the device with slots spaced in different locations. Going from left to right lengthwise, the second two slots are closer to the first two slots than the third or fourth two. When the wires of the first holding arm are placed in the first two slots, and the wires of the second arm are placed in the second two slots, the arms are closer together than they would be if the wires of the second arm were placed in the third or fourth two slots. This construction of the plate allows the clamp to be made to fit door beams that are narrower or wider by placing the wire arms in the slots made to the specification of the desired width door beam. The clamp therefore is adjustable to any specified width narrow or wide, in order to fit all width door beams.

Figure 4:
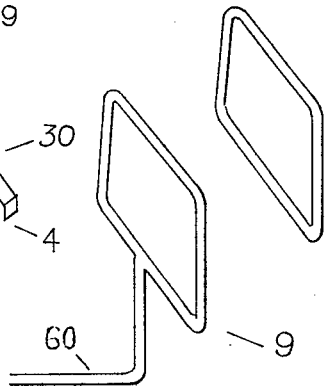
FIG. 4 shows two wire holding arms in position for being inserted into the first and third sets of slots in the plate.
Figure 5:
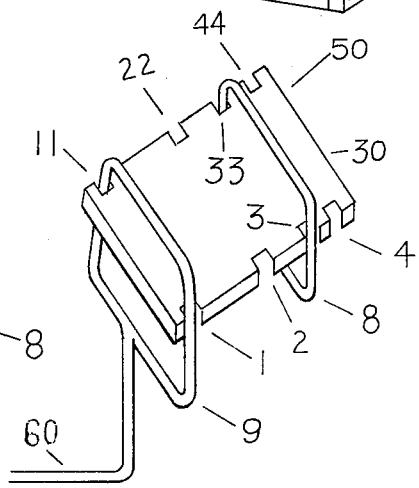
FIG. 5 shows the adjustable clamp part of the device assembled with the wire holding arms inserted into the slots in the plate.

FIG. 4 shows two wire holding arms in position for being fitted into the first and third slots of the plate, as shown in FIG. 5. These holding arms when inserted into the plate grasp both sides of the door beam tightly, therefore holding the clamp secure to the door beam.

FIG. 5 shows the assembled clamp part of the device, with the load-supporting arm which holds the garments. The load-supporting arm which holds the garments is attached to holding arm 9. In fact holding arm 9 and the load-supporting arm is made in one piece. In FIG. 5 the holding arms are inserted in the first and third two slots of the plate. If the holding arm shown in the third slots was placed in the second slots, the arms would be closer together, and if the arm shown in the third slots was placed in the fourth slots, the arms would be further apart. Therefore by placing the arms closer together or further apart in the slots made to specification of different width door beams, all width door beams would be accommodated.

The device consists of two materials, a sheet metal plate having slots, or square or oblong holes perforated through the plate at various locations, for accommodating the wire holding arms in different positions in order that they will fit different width door beams.

A wire element that is bent and shaped in various locations in order to form the necessary parts which are the holding arms of the clamp 8 and 9, and the horizontal load-supporting or extending arm 60 which holds the garments over the interior of the bathtub, so they will drip into the bathtub while drying. The sheet metal plate 30 is used for the top of the clamp 50 and gives the clamp support from the top where it fits the top of the square door beam. The plate is made with slots spaced in different locations to specifications in order to make the clamp adjustable to fit shower door beams of all widths.

Referring more particularly to the various views in the accompanying drawing, in which like numerals identify similar parts throughout, it will be seen that one embodiment of the invention, which is illustrated at 30 in FIGS. 1,2,3, and 5 preferably is a sheet metal plate.

FIG. 1 shows a shower enclosure with the adjustable drip dry support fastened by the clamp of the device on the square shower door beam, and the device is supporting drip dry wearing apparel which is held by the extending arm over the interior of the bathtub in order that it will drip into the bathtub while drying. Square shower door beam, a beam of square cross section 10. Adjustable drip dry support apparatus 20. Sheet metal plate 30 with slots spaced in different locations according to the specifications, in order that the clamp will fit different width door beams. Wire holding arm against the front side of the door beam 8. Wire holding arm against the rear side of the door beam 9. Clamp part of the device 50, which consists of the plate with slots 30, and front wire holding arm 8, and rear wire holding arm 9. This clamp part of the device 50 fits over and fastens securely to the square door beam 10 and supports the load-supporting extending arm 60, which the garments are hung on. Drip dry apparel load-supporting or extending arm of the device 60, is made of material so that the arm will collapse if the weight exceeds that sustainable by the door beam thereby protecting the door beam.

Large ring of the device 40, for fastening things with clothes pins, for draping wearing apparel, and for holding a garment open for quick drying, by opening up the garment and spreading it over the entire ring. Hook 70. Several hooks may be used, hooks for accommodating clothes hangers, or differently designed hooks for other type hangers. Clothes pin 100. Clothes Hanger 200. Ladies Blouse 300. Stocking 400. Handkerchief 500.

FIG. 2 shows the clamp part 50 of the embodiment of the present device with a view from the rear. The horizontal load-supporting arm 60, which holds the garments is attached to holding arm 9. In fact holding arm 9 and the load-supporting arm 60 is made in one piece. Wire holding arm 9 is shown against the rear side of door beam 10.

FIG. 3 shows the plate part 30 of the device, with slots made to specifications so that the clamp will fit different width door beams. Wire holding arms 8 and 9 are inserted into these slots as shown in FIG. 5. Wire holding arms inserted in slots closer together will fit narrower door beams than wire holding arms inserted in slots farther apart. First slots 1 and 11, second slots 2 and 22, third slots 3 and 33, fourth slots 4 and 44. All slots are used for the purpose of holding the wire holding arms firm, and securely against the door beam 10. All slots are also used for holding the wire holding arms fixed in the plate, at the desired location. The slot locks the wire holding arms and prevents them from having flexibility or movement, in order that the arms are firm and fit tightly and securely, and the arm is locked by the slot in the exact location, so that it cannot move or drift to another location on the plate.

FIG. 4 shows the wire holding arms of the device which fit tightly against both sides of the door beam so that the clamp is held securely to the door beam, see FIG. 1.

Wire holding arm 8 fits against the front side of the door beam, and wire holding arm 9 fits against the rear side of the door beam. Wire holding arm 8 is shown in FIG. 5 inserted into slots 3 and 33 of the plate. Wire holding arm 9 is shown in FIG. 5 inserted into slots 1 and 11. The horizontal load-supporting arm 60, which holds the garments is attached to holding arm 9. In fact holding arm 9 and the load-supporting arm 60 is made in one piece. The clamp part of the device 50 shown in FIG. 5, may be taken apart and disassembled for storage, by removing the load-supporting arm 60 which is attached to holding arm 9, and in fact is in one piece, by removing holding arm 9 from slots 1 and 11 as shown in FIG. 5, then removing holding arm 8 in the same manner.

FIG. 5 shows the clamp part of the device 50, which fits securely over the square door beam, a beam of square cross section 10 on the top and both sides. The clamp shown in FIG. 5 is an assembled combination of FIG. 3 the plate, and FIG. 4 the wire holding arms. The clamp 50 is assembled by taking wire holding arm 8 and inserting it into slots 3 and 33 of the plate, then taking wire holding arm 9 and inserting it into slots 1 and 11. The clamp now is assembled to fit a door beam with the width measurements equal to the distance between slots 1 and 11, and slots 3 and 33, this is the same distance between wire holding arms 8 and 9.

If it were desirable to adjust the clamp to fit a door beam which is narrower, wire holding arm 8 would be inserted into slots 2 and 22. To adjust the clamp to fit a door beam which is wider, wire holding arm 8 would be inserted into slots 4 and 44. This makes the clamp adjustable to any width door beam, as long as the slots in the plate are made in the exact locations to conform with the exact width of the door beam, or many door beams.

I claim:

1. An adjustable clothes drying device usable with a bathtub enclosure having a shower door beam of square cross section, the device comprising an adjustable clamp for fitting over the door beam and a cantilever arm horizontally extending outwardly from the clamp toward the interior of the bathtub enclosure, the clamp being constructed from an oblong plate of sheet material having opposite sides, said plate having at least three pairs of slots, one slot of each pair extending inwardly from one of said opposite sides and the other slot of each pair extending inwardly from the other of said opposite sides, said clamp further including a pair of spaced apart rectangular shaped clamping members, one of said clamping members engaging the slots of one of said pairs of slots and the other of said clamping members engaging the slots of another of said pairs of slots, whereby the position of said clamping members may be selected in accordance with the size of said door beam such that when the oblong plate is positioned against the top of the door beam the clamping members straddle the door beam to stabilize the drying device.

2. The device of claim 1 wherein the rectangular shaped clamping members are made of wire.

3. The device of claim 1 wherein the cantilever arm is an integral part of one of the clamping members.

4. The device of claim 1 wherein the cantilever arm has a ring at its free end, and a plurality of fasteners engageable with the cantilever arm for suspending wet clothes over a bathtub.

* * * * *